US008144096B2

(12) United States Patent
Ooki et al.

(10) Patent No.: US 8,144,096 B2
(45) Date of Patent: Mar. 27, 2012

(54) LIQUID CRYSTAL DISPLAY DEVICE

(75) Inventors: Youichi Ooki, Mobara (JP); Hiroyuki Takahashi, Funabashi (JP); Shigeo Adachi, Chiba (JP)

(73) Assignees: Hitachi Displays, Ltd., Chiba-Ken (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 464 days.

(21) Appl. No.: 12/382,225

(22) Filed: Mar. 11, 2009

(65) Prior Publication Data

US 2009/0231257 A1 Sep. 17, 2009

(30) Foreign Application Priority Data

Mar. 13, 2008 (JP) ..... 2008-064455

(51) Int. Cl.
*G09G 3/36* (2006.01)

(52) U.S. Cl. ..... 345/89; 345/100; 345/690

(58) Field of Classification Search ..... 345/87–100, 345/204, 690

See application file for complete search history.

(56) References Cited

U.S. PATENT DOCUMENTS

| | | | | |
|---|---|---|---|---|
| 7,023,458 | B2 * | 4/2006 | Kudo et al. | 345/690 |
| 7,262,756 | B2 * | 8/2007 | Nakagawa et al. | 345/89 |
| 2002/0163490 | A1 * | 11/2002 | Nose | 345/89 |
| 2007/0216633 | A1 * | 9/2007 | Kim | 345/100 |
| 2008/0198118 | A1 * | 8/2008 | Choi | 345/89 |

FOREIGN PATENT DOCUMENTS

JP 06-004046 6/1992

* cited by examiner

*Primary Examiner* — Kimnhung Nguyen
(74) *Attorney, Agent, or Firm* — Stites & Harbison, PLLC; Juan Carlos A. Marquez, Esq.

(57) ABSTRACT

Provided is a drive circuit low in power consumption and high in display quality for a liquid crystal display device that is used in a small-sized portable device. The liquid crystal display device includes liquid crystal display elements and a liquid crystal driving circuit. The liquid crystal driving circuit is mounted to one of the four sides of a liquid crystal display panel, and is capable of outputting two-system counter electrode voltages. A variable resistor circuit having a resistance value which is variably adjusted by a register is used to correct and output a gray scale voltage according to a position of a relevant scanning signal line. Equalization is also performed by short-circuiting two counter electrode signal lines.

9 Claims, 11 Drawing Sheets

LIQUID CRYSTAL DISPLAY DEVICE

CROSS-REFERENCE TO RELATED APPLICATION

The present application claims priority from Japanese application JP 2008-064455 filed on Mar. 13, 2008, the content of which is hereby incorporated by reference into this application.

BACKGROUND OF THE INVENTION

1. Field of the Invention

The present invention relates to a liquid crystal display device. More particularly, the present invention relates to a technique applicable to a drive circuit of a liquid crystal display device that is used as a display part of a portable device.

2. Description of the Related Art

Tin film transistor (TFT) liquid crystal display devices are widely used as a display device for personal computers, television sets, and the like. These liquid crystal display devices includes a liquid crystal display panel and a drive circuit for driving the liquid crystal display panel.

Among liquid crystal display devices of this type, small-sized ones are popular as a display device for portable devices such as cellular phones. A liquid crystal display device that is used as a display device of a portable device needs to be small in size and yet high in definition.

Generally speaking, enhancing the definition of a liquid crystal display device increases the wiring length, reduces the wiring width, and causes other phenomena that raise the wiring resistance value. As a result, at a location distant from the drive circuit, the electric potential falls due to a drop in voltage and the signal waveform is dulled.

JP 06-004046 A (hereinafter, referred to as Patent Document 1) describes a liquid crystal display device that varies the applied voltage depending on the position of a relevant scanning signal line. Patent Document 1, however, merely touches upon varying the applied voltage and does not mention a circuit that corrects the applied voltage depending on the position.

Liquid crystal display devices as a display device for portable devices are requested to be further enhanced in definition. Enhancing the definition of a high-definition liquid crystal display device means even longer wiring lines of the liquid crystal display panel, even narrower wiring width to keep the aperture ratio high, and an even larger wiring resistance value.

In conventional liquid crystal display devices, inverse display voltages are applied to adjacent pixel electrodes while the common voltage (the voltage of a counter electrode) is kept constant. For further lower voltage driving, conventional liquid crystal displays employ "common alternate driving" (polarity inversion) in which the common voltage is changed as well toward a polarity reverse to that of voltages applied to pixel electrodes.

Despite the fact that the common voltage in common alternate driving frequently switches between the positive polarity and the negative polarity, counter electrode signal lines which supply the common voltage are limited to a narrow wiring width, and the counter electrode signal lines having a narrow wiring width raise a problem in that the counter electrode voltage is not steady depending on the level of voltages written to pixel electrodes or the length of the signal lines.

Specifically, in common alternate driving, a single counter electrode signal line supplies a positive polarity or negative polarity common voltage to all pixels that constitute a row that is being scanned for the duration of the scanning of the row.

In this type of driving, when the number of pixels in the lateral direction is high, the amount of electric charges supplied by a single counter electrode signal line can exceed the supply capacity of the signal line. On the other hand, increasing the number of pixels in the longitudinal direction while keeping the frame frequency constant shortens the scanning time per row and there is not enough time to supply sufficient electric charges from a single common wiring line. This also increases the wiring resistance of counter electrode signal lines and accordingly worsens the problem in that a change in pixel electrode voltage changes the common voltage at a location distant from the drive circuit.

In addition, common alternate driving where the polarity of the common voltage is frequently inversed puts heavy load on the drive circuit. Another problem is that, in data signal lines, too, an increase in wiring resistance of data signal lines causes a drop in voltage at a location distant from the drive circuit.

Fundamentally, pushing a high resolution to a higher level requires supplying more current in a shorter period of time, and it is therefore necessary to widen the wiring width and thereby lower the wiring resistance in order to keep a change in common voltage small enough to cause no problems in a displayed image. On the other hand, the aperture ratio has to be satisfactorily high, and obtaining a high aperture ratio requires the contrary, i.e., narrowing the wiring width of counter electrode signal lines and other wiring lines.

SUMMARY OF THE INVENTION

The present invention has been made to solve the above-mentioned problems of prior art, and an object of the present invention is therefore to provide a drive circuit and a liquid crystal display panel that are capable of supplying data signals in a manner that accommodates to a change in common voltage in a small-sized liquid crystal display device.

The aforementioned and other objects as well as novel features of the present invention are clarified through the descriptions herein and the accompanying drawings.

In order to solve the above-mentioned problems, aspects of the present invention are as follows.

(1) A liquid crystal display device according to one aspect of the present invention includes: a first substrate; a second substrate; a liquid crystal composition which is held between the first substrate and the second substrate; a plurality of pixel electrodes which are provided on the first substrate; a counter electrode which is placed to face corresponding one of the plurality of pixel electrodes; a switching element which supplies a data signal to corresponding one of the plurality of pixel electrodes; a data signal line which supplies the data signal to the switching element; a scanning signal line which supplies a scanning signal for controlling the switching element; a counter electrode signal line which supplies a voltage to the counter electrode; and a drive circuit which outputs the data signal and the scanning signal, in which the drive circuit includes a gray scale voltage generating circuit, and in which the gray scale voltage generating circuit includes a variable resistor circuit having a resistance value which is varied depending on a position of the scanning signal line.

(2) In the liquid crystal display device according to Item (1), the gray scale voltage generating circuit may include a gamma correction circuit, and adjust a reference gray scale voltage, which is output from the gamma correction circuit, by using the variable resistor circuit.

(3) In the liquid crystal display device according to Item (1), the variable resistor circuit may include a plurality of resistors, which are connected in series, and an analog switch, which short-circuits input terminals and output terminals of the plurality of resistors.

(4) A liquid crystal display device according to another aspect of the present invention includes: a first substrate; a second substrate; a liquid crystal composition which is held between the first substrate and the second substrate; a plurality of pixel electrodes which are provided on the first substrate; a counter electrode which is placed to face corresponding one of the plurality of pixel electrodes; a switching element which supplies a data signal to corresponding one of the plurality of pixel electrodes; a data signal line which supplies the data signal to the switching element; a scanning signal line which supplies a scanning signal for controlling the switching element; a first counter voltage line and a second counter voltage line which supply voltages to the counter electrode; and a drive circuit which outputs the data signal and the scanning signal, in which the drive circuit includes a gray scale voltage generating circuit, and in which the gray scale voltage generating circuit adjusts a resistance value of a variable resistor circuit depending on a position of the scanning signal line, and thereby adjusts an amplitude of a gray scale voltage.

(5) In the liquid crystal display device according to Item (4), the gray scale voltage generating circuit may include a gamma correction circuit, and change a reference gray scale voltage, which is output from the gamma correction circuit, by using the variable resistor circuit to thereby adjust the amplitude of the gray scale voltage.

(6) In the liquid crystal display device according to Item (4), the variable resistor circuit may include a plurality of resistors, which are connected in series, and an analog switch, which short-circuits input terminals and output terminals of the plurality of resistors.

(7) A liquid crystal display device according to still another aspect of the present invention includes: a first substrate; a second substrate; a liquid crystal composition which is held between the first substrate and the second substrate; a plurality of pixel electrodes which are provided on the first substrate; a counter electrode which is placed to face corresponding one of the plurality of pixel electrodes; a switching element which supplies a data signal to corresponding one of the plurality of pixel electrodes; a data signal line which supplies the data signal to the switching element; a scanning signal line which supplies a scanning signal for controlling the switching element; a first counter voltage line and a second counter voltage line which supply counter voltages to the counter electrode; a drive circuit which outputs the data signal, the scanning signal, and the counter voltages; and an equalizer circuit which short-circuits the first counter voltage line and the second counter voltage line, in which the drive circuit includes a gray scale voltage generating circuit, and in which the gray scale voltage generating circuit varies a resistance value of a variable resistor circuit depending on a position of the scanning signal line, and thereby adjusts an amplitude of a gray scale voltage.

(8) In the liquid crystal display device according to Item (7), the gray scale voltage generating circuit may include a gamma correction circuit, and adjust a reference gray scale voltage, which is output from the gamma correction circuit, by using the variable resistor circuit to thereby adjust the amplitude of the gray scale voltage.

(9) In the liquid crystal display device according to Item (7), the variable resistor circuit may include a plurality of resistors, which are connected in series, and an analog switch, which short-circuits input terminals and output terminals of the plurality of resistors.

Of the above-mentioned liquid crystal display devices according to the present invention, the representative one is outlined as follows:

The liquid crystal display device includes: two substrates; a liquid crystal composition held between the two substrates; a plurality of pixels provided on one of the two substrates; a pixel electrode provided for each of the plurality of pixels; a counter electrode which faces the pixel electrode; a switching element which, when turned on, supplies a data signal to the pixel electrode; a data signal line which supplies the data signal to the switching element; a scanning signal line which supplies a scanning signal for controlling turning on/off of the switching element; a counter electrode signal line which supplies a common voltage to the counter electrode; and a drive circuit which outputs the data signal, the scanning signal, and the common voltage.

The drive circuit corrects the data signal in a manner that is suited to the position of the counter electrode signal line or the scanning signal line, and outputs the corrected data signal to the data signal line. In order to correct the data signal, the drive circuit includes a gamma correction circuit, a gray scale voltage amplitude adjustment circuit, and a gray scale voltage gradient adjustment circuit.

Effects that are obtained through the representative aspects of the invention disclosed in the present application are as follows:

According to the present invention, a change in common voltage can be dealt with by correcting a data signal in a manner that is suited to the position of the counter electrode signal line. Further, optimum data signal correction is accomplished by providing the drive circuit with a gamma correction circuit, a gray scale voltage amplitude adjustment circuit, and a gray scale voltage gradient adjustment circuit.

DETAILED DESCRIPTION OF THE INVENTION

An embodiment of the present invention is described in detail below with reference to the drawings.

Throughout all diagrams illustrating the embodiment, components that have the same function are denoted by the same reference symbol to avoid repetitive description.

Figure 1:
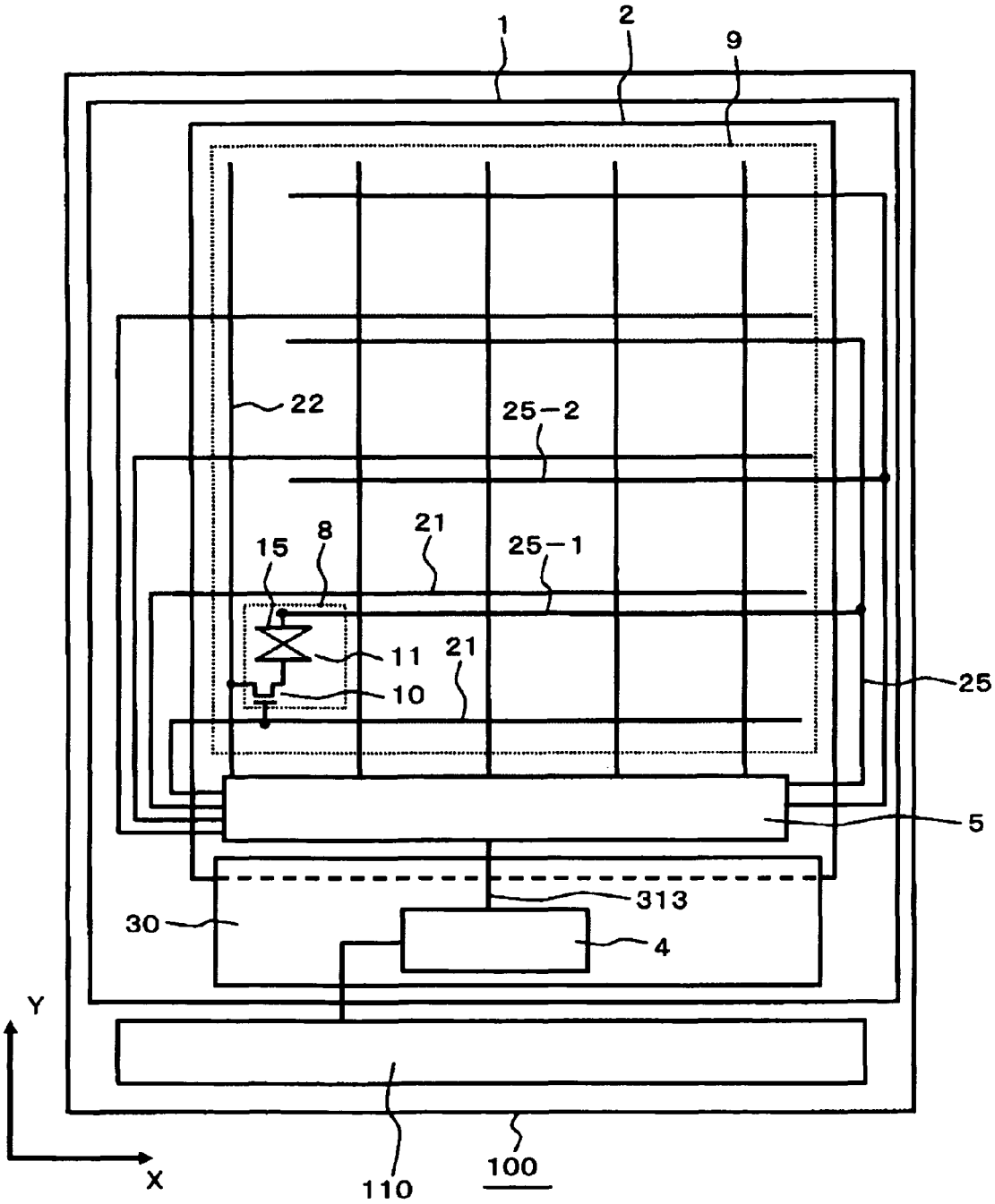
FIG. 1 is a block diagram illustrating a basic structure of a liquid crystal display device according to an embodiment of the present invention.

FIG. 1 is a block diagram illustrating a basic structure of a liquid crystal display device according to the embodiment of the present invention. As illustrated in FIG. 1, a liquid crystal display device 100 of this embodiment includes a liquid crystal display panel 1, a drive circuit 5, a flexible substrate 30, and a backlight 110.

The liquid crystal display panel 1 includes a TFT substrate 2 and a filter substrate (not shown in the drawing), which face each other across a given distance, and a liquid crystal composition, which is interposed between the two substrates. A thin film transistor 10, a pixel electrode 11, a counter electrode (common electrode) 15, and others are formed on the TFT substrate 2. A color filter and others are formed on the filter substrate. The two substrates are bonded to each other with a sealing member, which is attached near the rims of the substrates like a frame. In bonding the substrates, the liquid crystal composition is injected into the space between the substrates, and the space is then sealed. Polarization plates are attached to the outsides of the substrates. The flexible substrate 30 is connected to the TFT substrate 2.

This embodiment is applicable to a "lateral field effect" liquid crystal display panel, where the counter electrode 15 is placed on the TFT substrate 2, and a "vertical field effect" liquid crystal display panel, where the counter electrode 15 is placed on the filter substrate, alike.

In FIG. 1, scanning signal lines (also called gate signal lines) 21 running in a direction x of FIG. 1 are laid side by side in a direction y, and data signal lines (also called drain signal lines) 22 running in the direction y are laid side by side in the direction x. A pixel portion 8 is formed in each of regions enclosed by the scanning signal lines 21 and the drain signal lines 22.

The liquid crystal display panel 1 includes many pixel portions 8 in a matrix pattern but only one pixel portion 8 is illustrated in FIG. 1 in order to simplify the drawing. The plurality of pixel portions 8 arranged into a matrix pattern constitute a display area 9. In other words, the pixel portions 8 are each a pixel in a displayed image, and the pixel portions 8 emit light to thereby display an image in the display area 9.

The thin film transistor 10 in the pixel portion 8 has a source connected to the pixel electrode 11, a drain connected to one of the data signal lines 22, and a gate connected to one of the scanning signal lines 21. The thin film transistor 10 functions as a switch for supplying a display voltage (gray scale voltage) to the pixel electrode 11. While the terms source and drain are reversed depending on the bias direction, here, a terminal that is connected to the data signal line 22 is referred to as drain. The pixel electrode 11 and the counter electrode 15 constitute a capacitor (liquid crystal capacitor).

The drive circuit 5 is placed on a transparent insulating substrate (e.g., glass substrate or resin substrate) that constitutes the TFT substrate 2, and to the side of the display area 9. The drive circuit 5 is connected to the scanning signal lines 21, the data signal lines 22, and the counter electrode signal lines 25.

The flexible substrate 30 is connected to the TFT substrate 2. The flexible substrate 30 is provided with a connector 4. The connector 4 is connected to an external signal line through which a signal from the outside is input to the connector 4. A wiring line 313 is provided between the connector 4 and the drive circuit 5, and a signal from the outside is input to the drive circuit 5 through the wiring line 313.

The flexible substrate 30 supplies a constant voltage to the backlight 110. The backlight 110 is used as a light source of the liquid crystal display device 100. The backlight 110 is placed on the rear side or front side of the liquid crystal display panel 1. FIG. 1 illustrates the backlight 110 and the liquid crystal display panel 1 side by side for the sake of simplification.

A control signal sent from a control device (not shown in the drawing) which is placed outside of the liquid crystal display device 100 and a supply voltage supplied from an external power supply circuit (not shown in the drawing) are input to the drive circuit 5 through the connector 4 and the wiring line 313.

Signals input to the drive circuit 5 from the outside include control signals such as a clock signal, a display timing signal, a horizontal synchronization signal, and a vertical synchronization signal, display data (R, G, and B), and a display mode control command. With these input signals, the drive circuit 5 drives the liquid crystal display panel 1.

The drive circuit 5 is built from a one-chip semiconductor integrated circuit (LSI). The drive circuit 5 includes an output circuit for outputting scanning signals to the scanning signal lines 21, an output circuit for outputting data signals to the data signal lines 22, and an output circuit for outputting counter electrode voltages (common voltages) to the counter electrode signal lines 25.

The drive circuit 5 generates reference clocks based on the above-mentioned input signals. Based on the thus generated reference clocks, the drive circuit 5 supplies a "High" level selecting voltage (scanning signal) to the scanning signal lines 21 of the liquid crystal display panel 1 one by one for one cycle of horizontal scanning time. In this way, the plurality of thin film transistors 10 respectively connected to the scanning signal lines 21 of the liquid crystal display panel 1 keep their pixel electrodes 11 electrically connected to the data signal lines 22 for the duration of one horizontal scanning period.

The drive circuit 5 also outputs to the data signal lines 22 gray scale voltages corresponding to luminances at which pixels emit light. When the thin film transistors 10 are on (in a conductive state), gray scale voltages (data signals) are supplied from the data signal lines 22 to the pixel electrodes 11. The supplied gray scale voltages are kept in the pixel electrodes 11 when the thin film transistors 10 are subsequently turned off.

A counter electrode voltage is applied to the counter electrode 15, and the liquid crystal display panel 1 causes a pixel to emit light by utilizing the electric potential difference between the pixel electrode 11 and the counter electrode 15 to change the alignment direction of liquid crystal molecules that are located between the pixel electrode 11 and the counter electrode 15 and to thereby change the light transmittance or reflectance.

In order to implement alternating driving, the drive circuit 5 performs common inversion driving in which a counter electrode voltage having polarity to be inverted for every given period of time is output to the counter electrode signal lines 25. The polarity of the counter electrode signal line 25-2 is therefore reverse to that of the counter electrode signal line 25-1. The counter electrode signal lines 25 are connected to the drive circuit 5 and, at a location distant from the drive circuit 5, the influence of the wiring resistance of the counter electrode signal lines 25 is too large to be ignored due to the long wiring length from the drive circuit 5.

As described above, when a scanning signal turns one thin film transistor 10 on, a gray scale voltage is supplied to the pixel electrode 11 from the data signal line 22. The voltage of the pixel electrode 11 at this point changes the voltage of the counter electrode 15, which is one of the two electrodes that constitute the capacitor.

When the wiring resistance of the counter electrode signal line 25 is high, the voltage change of the counter electrode 15 cannot be remedied while the thin film transistor 10 is on, which means a failure in setting the electric potential difference between the pixel electrode 11 and the counter electrode 15 to a desired value, and accordingly low display quality.

The counter electrode signal lines 25 and the scanning signal lines 21 are arranged side by side with respect to each other. The arrangement enables the drive circuit 5 to grasp the position of the counter electrode 15 in which a voltage change is occurring from the order of a scanning signal to be output.

Figure 2:
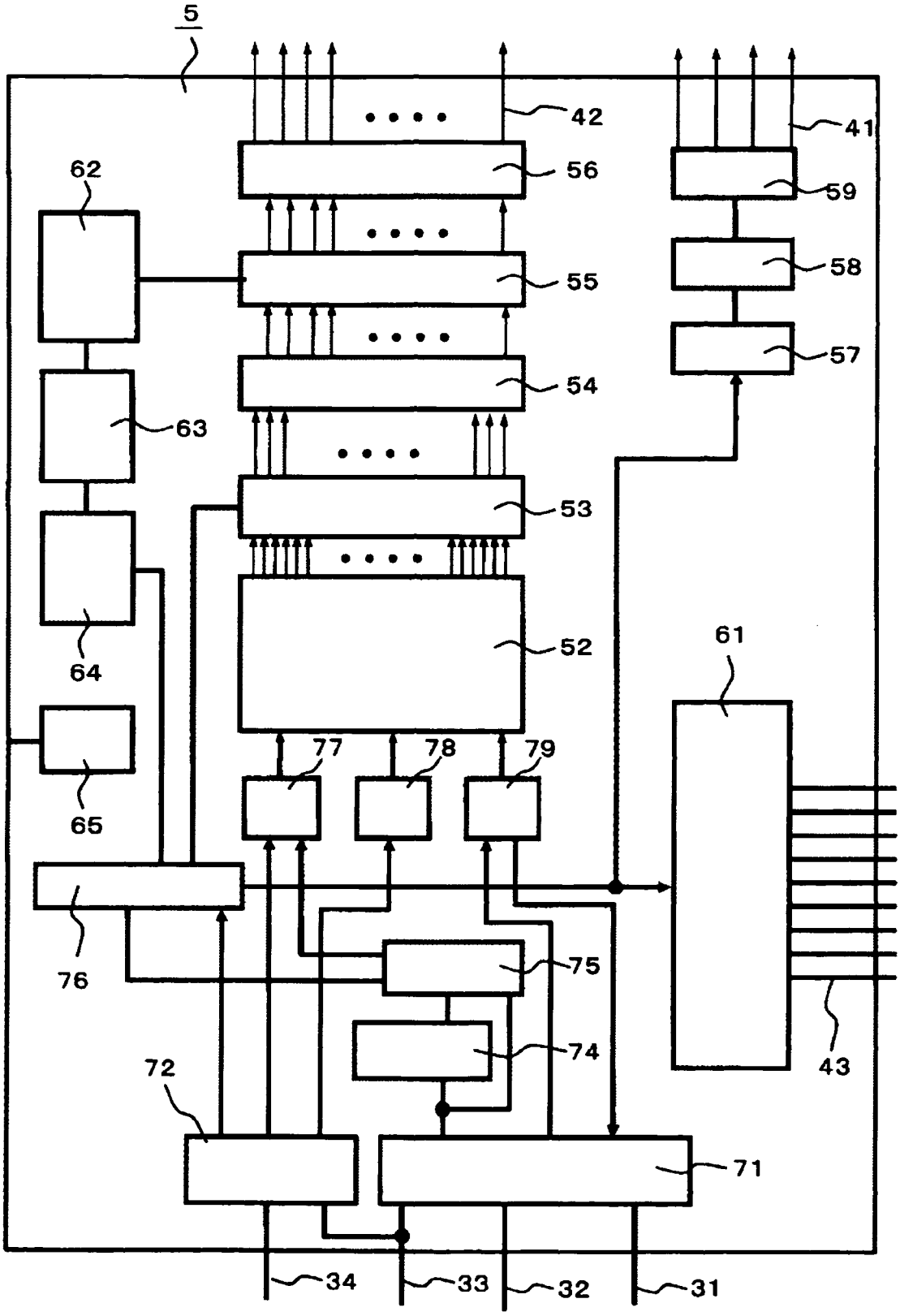
FIG. 2 is a block diagram illustrating an internal circuit structure of the liquid crystal display device according to the embodiment of the present invention.

FIG. 2 is a block diagram of an interior of the drive circuit 5. First, a signal input from the outside is input to a system interface 71 via an input wiring line 31. In the case of a data signal, part of the signal is input to an external display interface 72 as well. At the other end, signals and voltages necessary to drive the liquid crystal display panel 1 are output from a scanning signal line terminal 41, a data signal line terminal 42, and a voltage output terminal 43, which are output terminals.

The drive circuit 5 includes a built-in graphic RAM 52, which stores display data. To drive the liquid crystal display panel 1, the drive circuit 5 specifies an address in the graphic RAM 52 that is associated with the particular pixel 8 in the liquid crystal display panel 1, and writes display data in the graphic RAM 52. The drive circuit 5 outputs a gray scale voltage based on the display data within the graphic RAM 52 to the liquid crystal display panel 1.

The drive circuit 5 has various display modes, and specifies one of the display modes from the outside via the system interface 71. In specifying a display mode, the drive circuit 5 controls, for example, the counter electrode voltage (common voltage) output based on an instruction signal. The drive circuit 5 is thus capable of handling various display modes according to an instruction signal, and forming the drive circuit 5 on a single IC chip makes it a multi-function drive circuit that requires only a small mounting area.

In recent years, cellular phones that have a diversity of functions in addition to various display modes have been developed. Liquid crystal display devices used in cellular phones have come to accommodate these functions.

In this trend, the drive circuit 5, too, has functions for handling various display modes and needs to control these functions. The drive circuit 5 used in the liquid crystal display device 100 of this embodiment has registers, and implements the respective functions by setting values to the resisters.

The drive circuit 5 may have an automatic sequence function in order to save the trouble of setting many registers. However, an automatic sequence function requires determining in advance what functions can be handled, which means that a liquid crystal display device equipped with an automatic sequence function ends up having an individually-customized liquid crystal display panel. This in turn means that drive circuits suited to the respective specifications of the liquid crystal display panels need to be designed.

Another option is to provide an EPROM separately from the drive circuit 5 and store register setting values that are suited to the respective liquid crystal display panels in the EPROM, whereby a necessary setting value is read out of the EPROM upon input of an instruction signal from an external control circuit to the drive circuit 5.

Instruction signals are set generally through the system interface 71. The system interface 71 includes two types of interfaces, one for 18-bit, 16-bit, or any other arbitrary n-bit bus signals and the other for clock synchronization serial signals. The system interface 71 is capable of processing both parallel and serial signals sent from an external control circuit such as a micro processing unit (MPU).

The drive circuit 5 includes an index resister 74 and a control register 75, which are 16-bit registers, and a write data register 78 and a read data register 79, which are 18-bit registers. The registers each read and write data via the system interface 71. Denoted by reference symbols 31 and 32 are the input signal line and an output signal line, respectively. Denoted by a reference symbol 33 is a verification signal output line. Input data and output data are cross checked with the use of verification signals.

The external display interface 72 includes an RGB interface and a vertical synchronization interface for displaying videos, and data signals are input thereto from the outside via an input signal line 34. When the RGB interface is in operation, the external display interface 72 takes in display data in response to vertical synchronization signals and horizontal synchronization signals supplied from the outside.

When the vertical synchronization interface is in operation, the external display interface 72 synchronizes frames with vertical synchronization signals and uses internal clocks to take in display data.

The index register 74 is a register that stores access information of the control register 75 or the graphic RAM 52. With the index register 74, an address in the control register 75 and the graphic RAM 52 is specified.

The control register 75 specifies various functions of the drive circuit 5. The display operation is controlled by a value set to the control register 75. For example, how many signal lines are to be driven through the operation of a timing signal generating circuit 76 is specified by the control register 75.

The write data register 78 temporarily stores data to be written in the graphic RAM 52. Display data temporarily stored in the write data register 78 is written in the graphic RAM 52 via the external display interface 72 according to the setting value of the control register 75, the value of an address counter 77 to be described later, and the values of various control terminals.

The read data resister 79 is a register that temporarily stores read data that has been sent from the graphic RAM 52. Data temporarily stored in the read data register 79 is output to the outside according to the setting value of the control register 75, the value of the address counter 77 to be described later, and the values of various control terminals.

The address counter 77 is a counter that gives an address to the graphic RAM 52. When an instruction to set an address is written to the index register 74, the address information is transferred from the index register 74 to the address counter 77.

The graphic RAM 52 includes a static RAM (SRAM) that has an 18-bit-per-pixel structure to store bit pattern data of 172,800 bytes, and is capable of displaying a 240 RBG×320 size image at maximum.

The timing signal generating circuit 76 generates timing signals for putting internal circuits necessary to display an image into operation. The timing signal generating circuit 76 also generates such interface signals as ones for timing when to read data necessary to display an image out of the graphic RAM 52, and ones for timing when to put an internal circuit into operation upon access from the outside.

A latch circuit 53 temporarily keeps digital data of 240×3 lines to be output to the data signal lines 22. Once the signals to be output are prepared in the latch circuit 53, the latch circuit 53 outputs the display data to a first level shifter 54.

The first level shifter 54 converts the voltage levels of the signals kept in the latch circuit 53 into voltage levels at which a decoder circuit 55 can be controlled, and then outputs the voltages as signals.

Based on the input signals, the decoder circuit 55 outputs gray scale voltages. The voltages output from the decoder circuit 55 receive electric current amplification in a first output circuit 56, and then output to the data signal output terminal 42.

The data signal output terminal 42 is electrically connected to the data signal lines 22 of the liquid crystal panel 1. Through the data signal output terminal 42, the above-mentioned gray scale voltages are output to the data signal lines 22. The number of the data signal lines 22 to which the gray scale voltages are output, the positions of the data signal lines 22 where the output is started, and other similar settings are set to the control register 75 by instruction signals.

The drive circuit 5 also includes a scanning signal generating circuit 57 for the scanning signal lines 21. The scanning signal generating circuit 57 outputs scanning timing signals, which are converted into voltages by a second level shifter 58. The voltages are output as scanning signals to the scanning signal lines 21 by a second output circuit 59 via the scanning signal line terminal 41.

Still another component of the drive circuit 5 is a gray scale voltage generating circuit 62. The gray scale voltage generating circuit 62 generates a gray scale voltage and supplies the gray scale voltage to the decoder circuit 55. A gamma correction circuit 64 approximates the ratio of increase and decrease in gray scale voltage to a gamma function to accomplish a luminance transition that is adapted to the characteristics of the human eye. A gray scale voltage output amplifier 63 selects signals output by the gamma correction circuit 64, amplifies the selected signals, and output the amplified signals to the gray scale voltage generating circuit 62. A regulator 65 outputs a supply voltage for internal logic circuits. Details of the gamma correction circuit 64 are described later.

In this embodiment, the scanning signal generating circuit 57 identifies the positions of the scanning signal lines 21 to which scanning signals are being output. This embodiment is characterized in that gray scale voltages generated by the gray scale voltage generating circuit 62 are corrected according to the identified positions.

Gray scale voltages optimized to a change in counter electrode voltage are thus output to the data signal lines 22. A gray scale voltage is corrected by adjustment circuits inside the gamma correction circuit 64.

Figure 3:
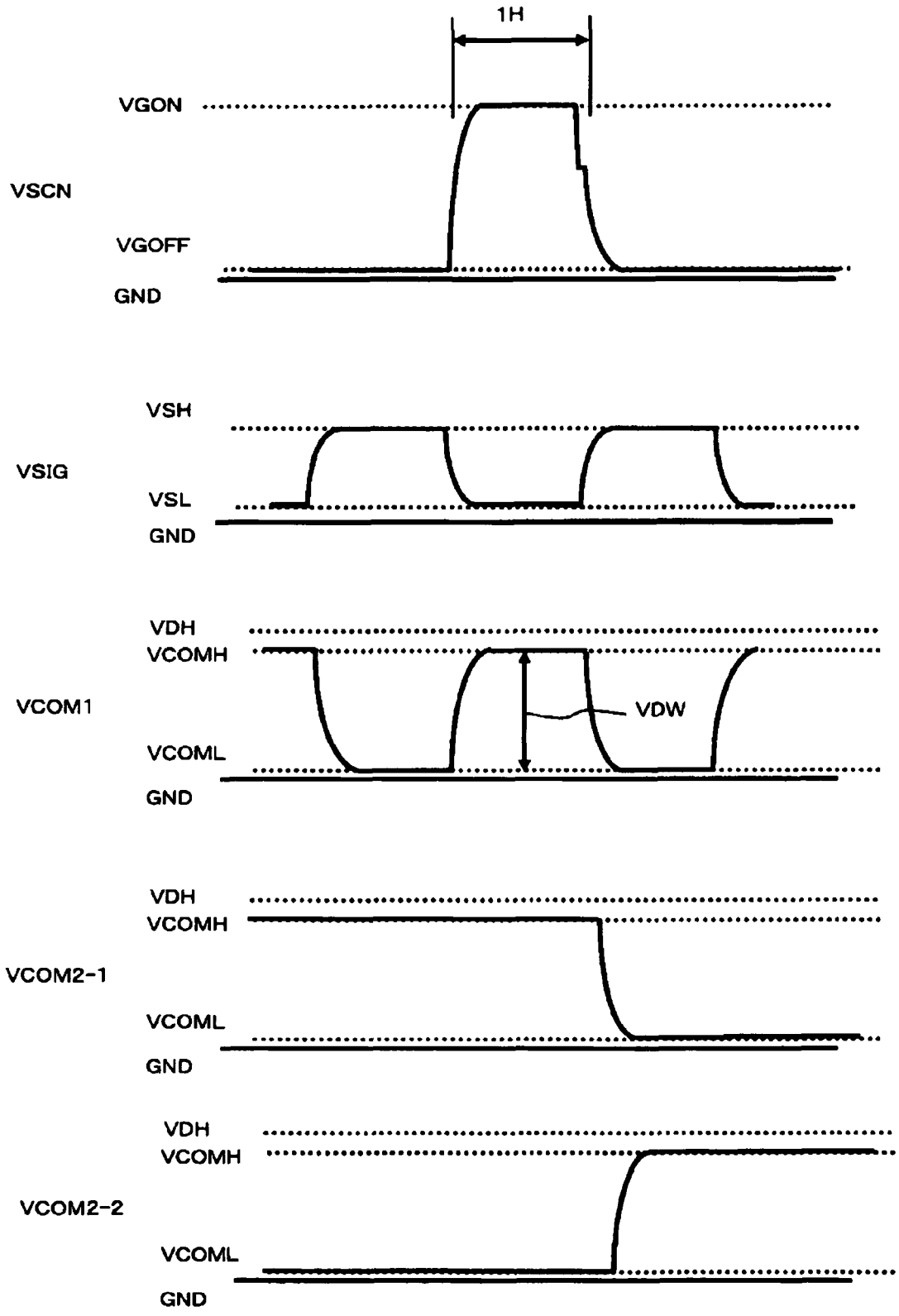
FIG. 3 is a schematic voltage waveform diagram illustrating a drive voltage of the liquid crystal display device according to the embodiment of the present invention.

FIG. 3 illustrates voltages generated by a liquid crystal driving voltage generating circuit 61 and signal waveforms generated from the voltages when the employed driving method is "common inversion driving" in which a counter electrode voltage VCOM supplied to the counter electrode 15 is inverted in regular cycles.

A scanning signal VSCN illustrated in FIG. 3 represents a scanning signal that is output to an arbitrary scanning signal line 21 from the second output circuit 59. As illustrated in FIG. 3, a period in which the scanning signal VSCN supplied to the scanning signal line 21 is a High voltage VGON is referred to as one horizontal scanning period (1 H). VGOFF represents a Low voltage.

In common inversion driving, the counter voltage VCOM is inverted for every horizontal scanning period and switched between, for example, VCOMH and VCOML as indicated by a reference symbol VCOM1. A change in counter voltage VCOM causes a data signal VSIG to change in a manner reverse to the change in VCOM. By employing common inversion driving, the electric potential difference between the data signal VSIG and the counter voltage VCOM can be set large even when the amplitude of the data signal VSIG is small. Low voltage driving and a reduction in power consumption are thus accomplished.

The reference symbol VCOMH represents a High counter electrode voltage and VCOML represents a Low counter electrode voltage. A reference symbol VDH represents a reference voltage that serves as the reference of the High counter electrode voltage VCOMH, and VDW represents an amplitude reference voltage that indicates the amplitude of the counter voltage. A reference symbol VSH of the data signal VSIG represents a positive gray scale voltage supplied to a pixel and having a positive polarity with respect to the counter voltage VCOM. A reference symbol VSL represents a negative gray scale voltage having a negative polarity with respect to the counter voltage VCOM.

The reference symbol VCOM1 represents a counter voltage in the case where there is a single counter electrode signal line 25 in line inversion driving in which the polarity is inverted for every horizontal scanning period. In the case where two counter electrode signal lines 25 are provided, the polarity of the counter voltage VCOM can be inverted for every several horizontal scanning periods or for every frame period as indicated by reference symbols VCOM2-1 and VCOM2-2.

With two counter electrode signal lines 25 provided, the High counter electrode voltage VCOMH may be output to, for example, the counter electrode signal line 25-1 while the Low counter electrode voltage VCOML is output to the counter electrode signal line 25-2, whereby the load on the output circuit is lightened.

Figure 4:
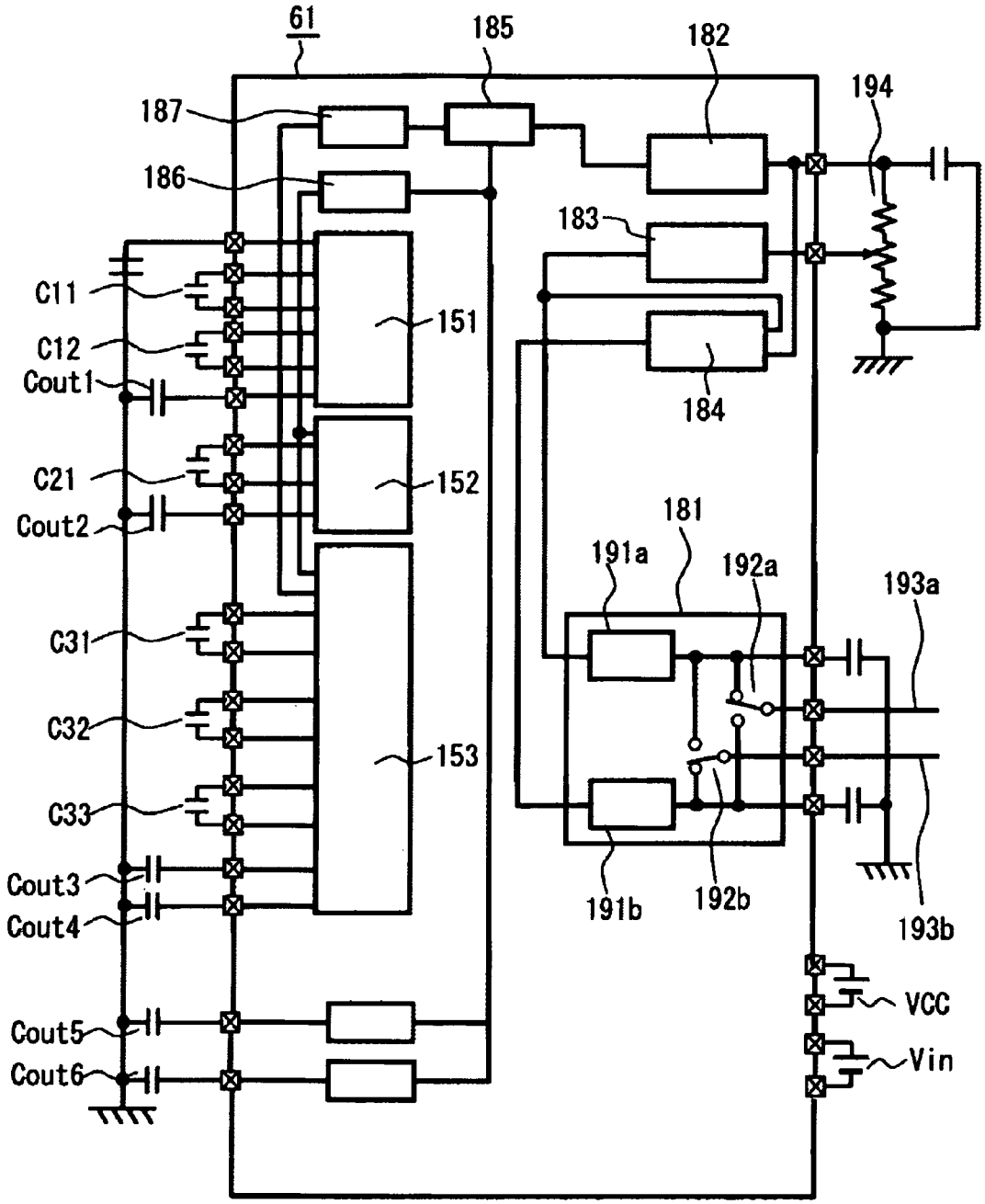
FIG. 4 is a block diagram illustrating an internal circuit structure of a liquid crystal drive voltage generating circuit which is illustrated in FIG. 2.

FIG. 4 is a block diagram of the liquid crystal driving voltage generating circuit 61, which generates the various voltages described above. A reference symbol 181 denotes a counter voltage output circuit; 182, a counter voltage reference voltage circuit; 183, a counter voltage High level adjustment circuit; 184, a counter voltage Low level adjustment circuit; and 185, a reference voltage generating circuit.

The counter voltage reference voltage circuit 182 outputs the reference voltage VDH, which serves as the reference of the counter voltage, based on a reference voltage output from the reference voltage generating circuit 185. An output from the counter voltage reference voltage circuit 182 is applied to a variable resistor 194, and the counter voltage High level adjustment circuit 183 generates the High counter electrode voltage VCOMH from a voltage input from the variable resistor 194. The counter voltage Low level adjustment circuit 184 generates the Low counter electrode voltage VCOML by setting the amplitude reference voltage VDW of the counter voltage.

Instead of using the variable resistor 194, the counter voltage High level adjustment circuit 183 may generate the High counter electrode voltage VCOMH by multiplying the reference voltage VDH by an adjustment value, which is kept in an internal non-volatile memory, fuse circuit, or the like, and setting VCOMH to the calculated voltage value.

An output from the counter voltage High level adjustment circuit 183 is input to a counter voltage High level output circuit 191*a* of the counter voltage output circuit 181. An output from the counter voltage Low level adjustment circuit 184 is input to a counter voltage Low level output circuit 191*b* of the counter voltage output circuit 181.

The counter voltage High level output circuit 191*a* outputs the High counter electrode voltage VCOMH, which is subsequently input to a switching element 192*a* and a switching element 192*b*. Similarly, the counter voltage Low level output circuit 191*b* outputs the Low counter electrode voltage VCOML, which is input to the switching element 192*a* and the switching element 192*b*.

The switching elements 192*a* and 192*b* are capable of outputting signals that have been output from the counter voltage High level output circuit 191*a* and the counter voltage Low level output circuit 191*b* to a first counter voltage output terminal 193*a* and a second counter voltage output terminal 193*b* while switching between the output signals of the circuits 191*a* and 191*b* in regular cycles. With the switching elements 192*a* and 192*b* designed as above, in a first period, the High counter electrode voltage VCOMH is output from the first counter voltage output terminal 193*a* while the Low counter electrode voltage VCOML is output from the second counter voltage output terminal 193*b*. In a second period, the Low counter electrode voltage VCOML is output from the first counter voltage output terminal 193*a* while the High counter electrode voltage VCOMH is output from the second counter voltage output terminal 193*b*. The first counter voltage output terminal 193*a* is connected to one of the counter electrode signal lines 25-1 and 25-2, and the second counter voltage output terminal 193*b* is connected to the other of the counter electrode signal lines 25-1 and 25-2.

A reference symbol 186 within the liquid crystal driving voltage generating circuit 61 denotes a first step-up reference voltage circuit, which outputs a reference voltage VCI for a first step-up circuit 151 and a second step-up circuit 152. A second step-up reference voltage circuit is denoted by a reference symbol 187 and outputs a reference voltage VDCDC for a third step-up circuit 153.

The first step-up circuit 151 generates a supply voltage DDVDH for a circuit that outputs data signals to the data signal line terminal 42 by stepping up the reference voltage VCI. The supply voltage DDVDH is used in the latch circuit 53, the first level shifter 54, the decoder circuit 55, and the first output circuit 56.

The second step-up circuit 152 generates a supply voltage VCL for driving the counter voltage Low level output circuit 191*b* by stepping up the reference voltage VCI.

The third step-up circuit 153 steps up the reference voltage VDCDC to generate a supply voltage VGH and a supply voltage VGL, which are used in the scanning signal generating circuit 57 for the scanning signal lines 21, the second level shifter 58, and the second output circuit 59.

Capacitors C11, C12, C21, C31, C32, and C33 are step-up capacitors and used in the step-up operations of the step-up circuits 151 to 153. Capacitors Cout1, Cout2, Cout3, Cout4, Cout5, and Cout6 are storage capacitor elements connected to the output terminals.

The gamma correction circuit 64 is described next with reference to FIG. 5. A reference symbol 601 denotes a gradient adjustment register; 602, a fine adjustment register; 603, an amplitude adjustment register; and 604, an amplitude correction register. The drive circuit 5 is capable of adjusting gray scale voltages by approximating the gray scale voltages to a gamma function with the use of values set to the registers.

Figure 6:
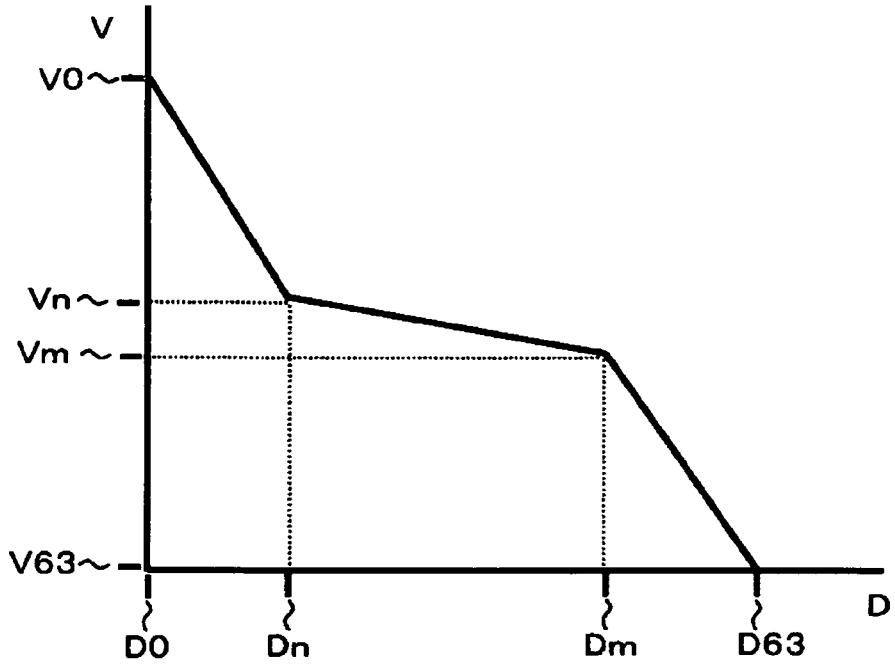
FIG. 6 is a gray scale voltage graph illustrating gamma correction of the liquid crystal display device according to the embodiment of the present invention.

Described first with reference to FIG. 6 is gamma correction. FIG. 6 illustrates a display data value D on the axis of abscissa and a gray scale voltage value V on the axis of ordinate. In the gamma correction, the rate of change (gradient) of the gray scale voltage V with respect to the display data D is adjusted.

The gamma correction circuit 64 generates a reference gray scale voltage that is approximated to a gamma function, and outputs the reference gray scale voltage to the gray scale voltage generating circuit 62 via the gray scale voltage output amplifier 63. The gray scale voltage generating circuit 62 generates gray scale voltages by dividing the reference gray scale voltage. Accordingly, by having the gamma correction circuit 64 generate a reference gray scale voltage that is approximated to a gamma function, gray scale voltages can be approximated to a gamma function as well.

As illustrated in FIG. 6, determining the value of a reference gray scale voltage Vn which is associated with display data Dn determines the gray scale voltage gradient of from display data D0 to the display data Dn. Gray scale voltages generated by dividing reference gray scale voltages V0 to Vn can thus be approximated to a gamma function as well.

Similarly, determining the value of the reference gray scale voltage Vn which is associated with the display data Dn and the value of a reference gray scale voltage Vm which is associated with display data Dm determines the gray scale voltage gradient of from the display data Dn to the display data Dm. Determining the value of the reference gray scale voltage Vm which is associated with the display data Dm and the value of a reference gray scale voltage V63 which is associated with display data D63 determines the gray scale voltage gradient of from the display data Dm to the display data D63.

Figure 5:
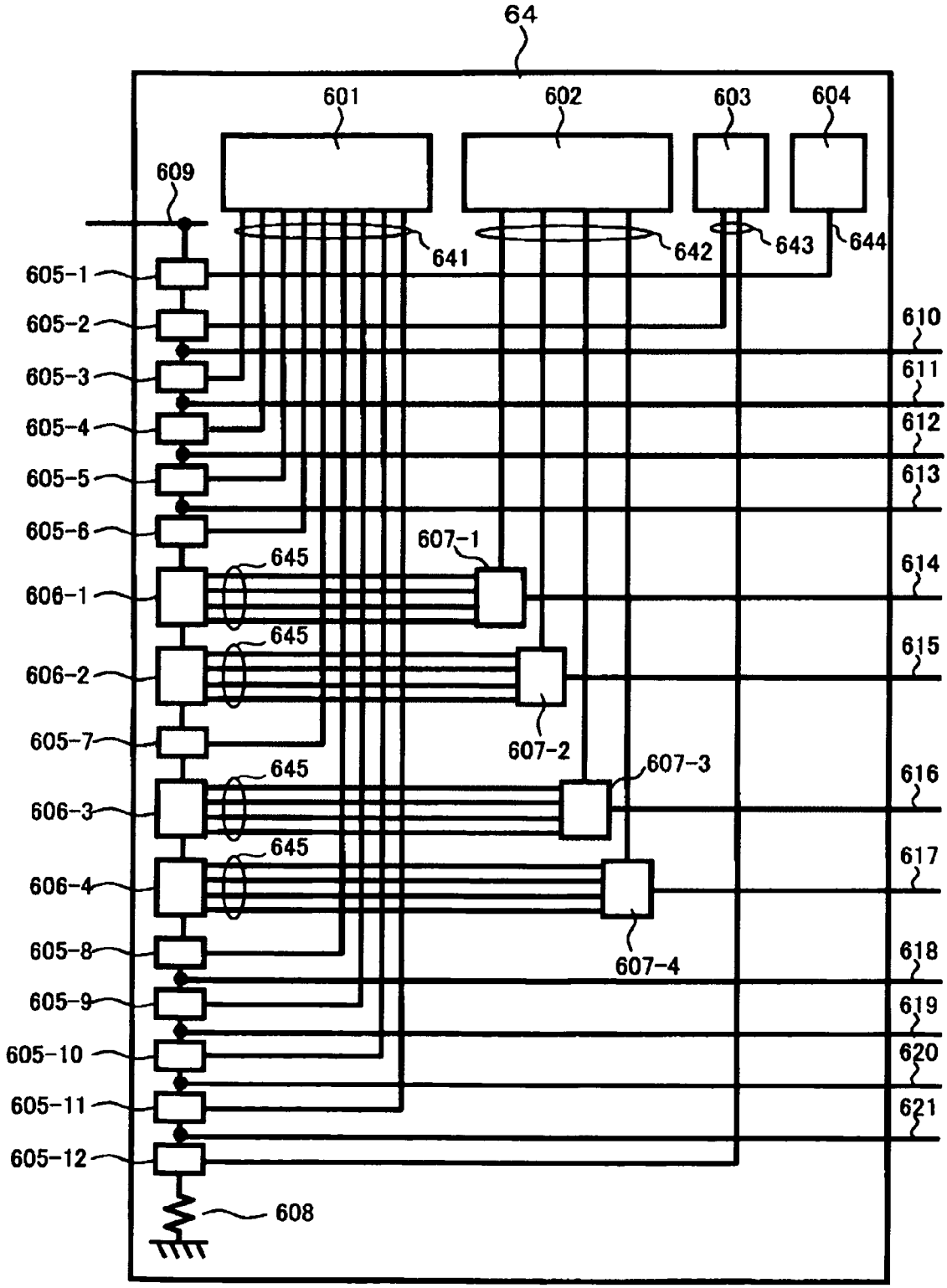
FIG. 5 is a block diagram illustrating an internal circuit structure of a gamma correction circuit which is illustrated in FIG. 2.

The description returns to FIG. 5 to describe the adjustment circuits within the gamma correction circuit 64. Denoted by a reference symbol 605 are variable resistor circuits as the one illustrated in FIG. 11. The variable resistor circuits 605 vary the resistance value depending on values set to the gradient adjustment register 601, the amplitude adjustment register 603, and the amplitude correction register 604.

Figure 12:
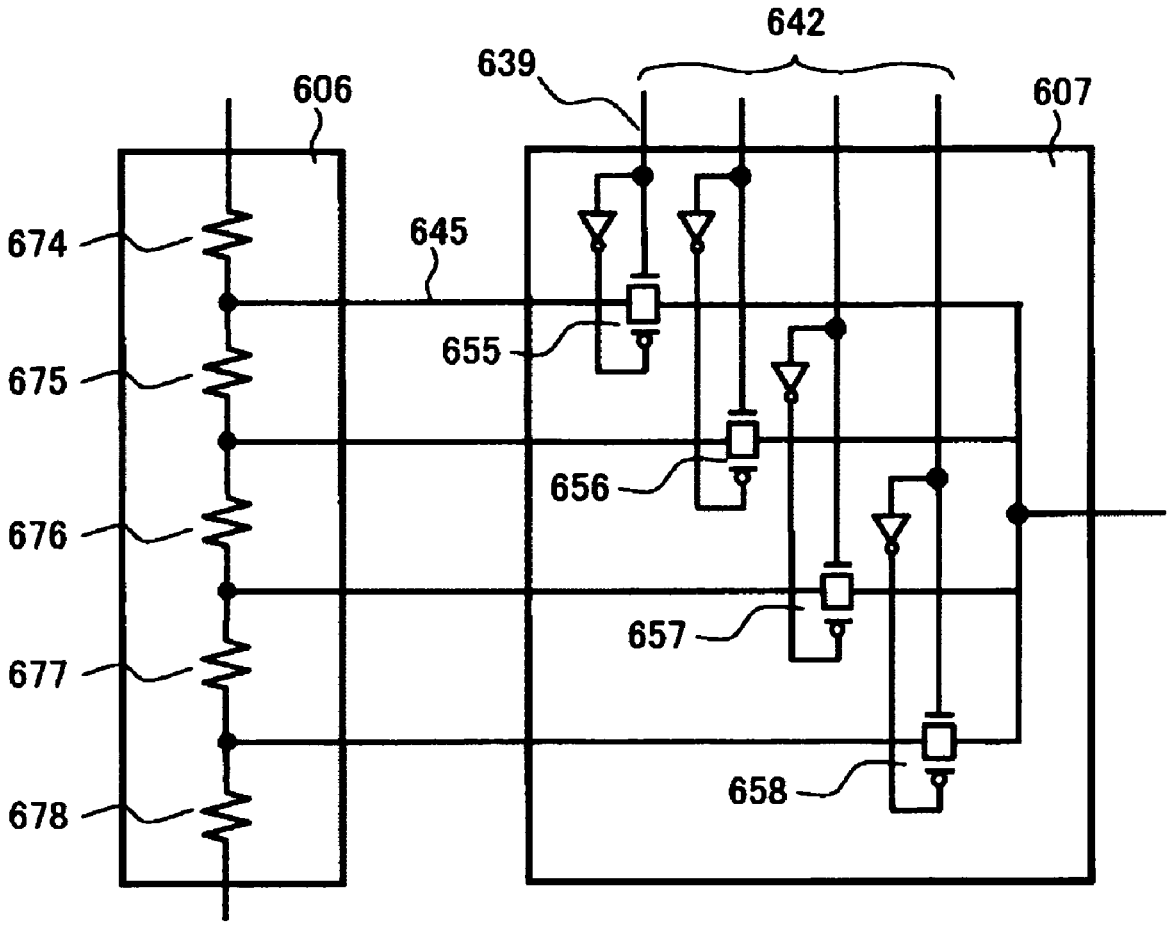
FIG. 12 is a circuit diagram illustrating a circuit structure of a ladder circuit which is illustrated in FIG. 5.

Denoted by a reference symbol 606 are ladder register circuits as the one illustrated in FIG. 12. The ladder register circuits 606 use selector circuits 607 to obtain voltages from respective contact points of ladder resistors based on a value set to the fine adjustment register 602.

A reference voltage supplied to the gamma correction circuit 64 via a wiring line 609 is divided by serial connection between the variable resistor circuits 605 and the ladder resistor circuits 606. The divided voltages are output as reference gray scale voltages to reference gray scale voltage wiring lines 610 to 621. Gray scale voltages can therefore adjusted by adjusting the value of a voltage that is divided with the use of the variable resistor circuits 605 and the ladder resistor circuits 606.

Figure 7:
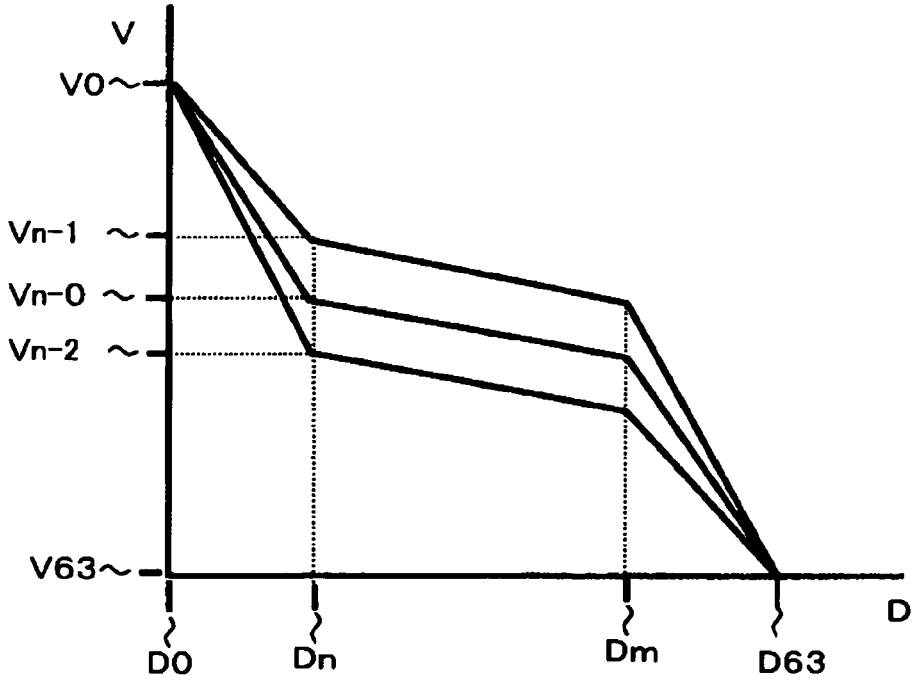
FIG. 7 is a gray scale voltage graph illustrating the gamma correction of the liquid crystal display device according to the embodiment of the present invention.

FIG. 7 illustrates a method of adjusting the gray scale voltage gradient using the gradient adjustment register 601. First, the gradient of from the reference gray scale voltage V0 to the reference gray scale voltage Vn, which is a first point of change, is described.

The gamma correction circuit 64 illustrated in FIG. 5 outputs the reference gray scale voltage V0 from the reference gray scale voltage wiring line 610, outputs a gray scale voltage V1 from the reference gray scale voltage wiring line 611, outputs a gray scale voltage V2 from the reference gray scale voltage wiring line 612, and outputs a gray scale voltage V3 from the reference gray scale voltage wiring line 613.

For example, the gamma correction circuit 64 corrects the value of the voltage output from the reference gray scale voltage wiring line 611 by changing the resistance value of the variable resistor circuit 605-3, which is connected between the reference gray scale voltage wiring line 610 and the reference gray scale voltage wiring line 611, with the gradient adjustment register 601.

When the resistance value of the variable resistor circuit 605-3 is lowered, the voltage drop amount is reduced and therefore a voltage output from the reference gray scale voltage wiring line 611 changes toward the voltage V0. In FIG. 7, a point at which the gradient changes is arbitrary display data Dn, and hence the output voltage changes from a reference gray scale voltage Vn-0 to Vn-1. Similarly, when the resistance value of the variable resistor circuit 605-3 is raised, the output voltage changes from the reference gray scale voltage Vn-0 to Vn-2.

The same applies to the rest and, by adjusting the values of the variable resistor circuit 605-4 and the variable resistor circuit 605-5, the gray scale voltage V2 output from the reference gray scale voltage wiring line 612 and the gray scale voltage V3 output from the reference gray scale voltage wiring line 613 can be adjusted, respectively.

The gradient of from the reference gray scale voltage V63 to the reference gray scale voltage Vm, which is a second point of change, can be adjusted similarly by adjusting the resistance values of the variable resistor circuits 605-9, 605-10, and 605-11.

Figure 11:
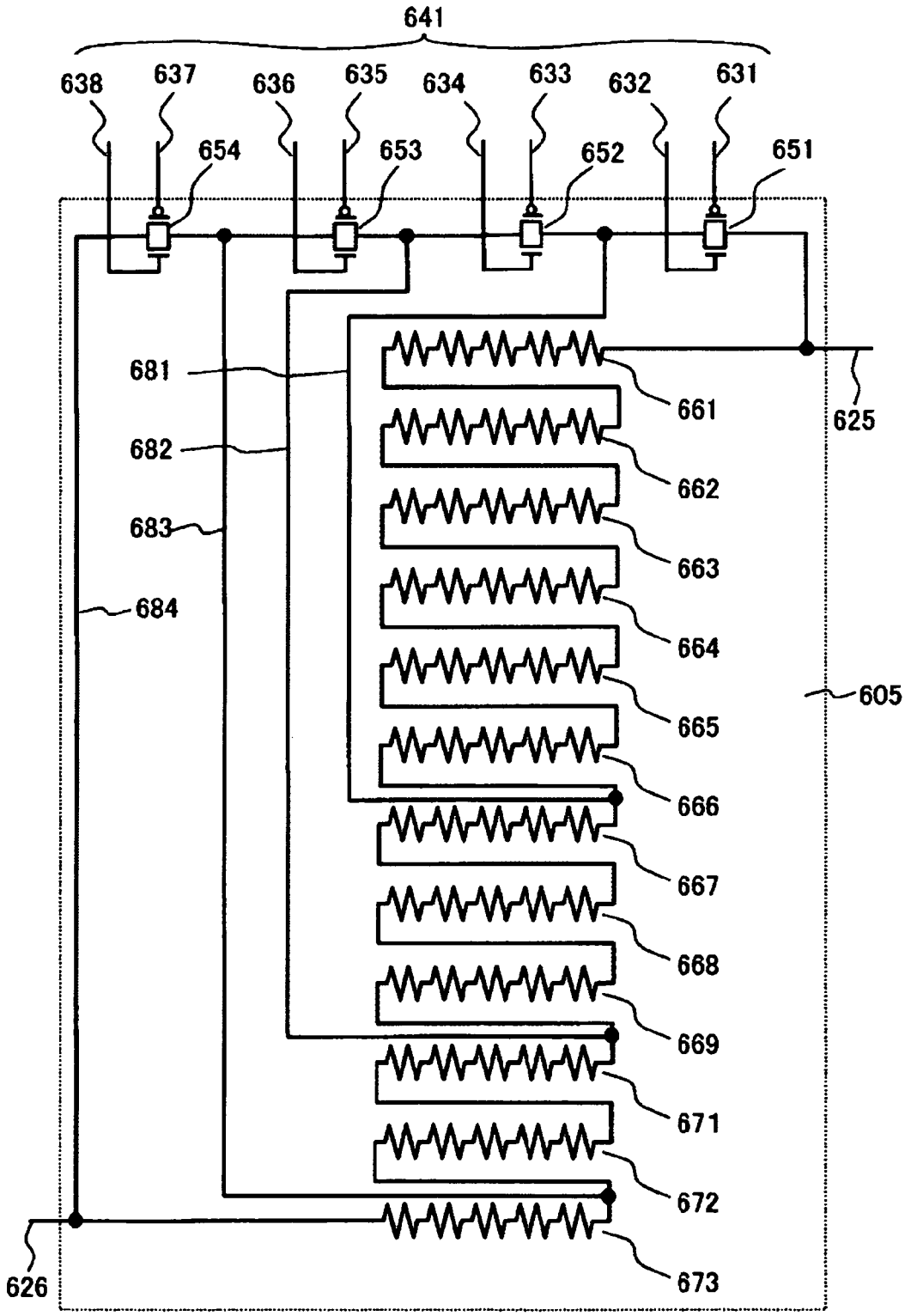
FIG. 11 is a circuit diagram illustrating a circuit structure of a variable resistor circuit which is illustrated in FIG. 5.

FIG. 11 is a schematic circuit diagram of each variable resistor circuit 605. The variable resistor circuit 605 uses a control signal 641 from the outside to control the resistance value between an input terminal 625 and an output terminal 626. Resistors 661 to 673 are connected in series between the input terminal 625 and the output terminal 626. The serially connected resistors 661 to 673 are parallel to analog switches 651, 652, 653, and 654, which are connected in series between the input terminal 625 and the output terminal 626.

The input terminal 625 is connected to the resistor 661 and one terminal of the analog switch 651. The other terminal of the analog switch 651 is connected to the resistor 666 via a wiring line 681. The resistors 661, 662, 663, 664, 665, and 666 are connected in series, and hence the analog switch 651 can short-circuit the input terminals and output terminals of the serially connected resistors. When a control signal line 631 is at a Low voltage and a control signal line 632 is at a High voltage, the input terminals and output terminals of the resistors 661, 662, 663, 664, 665, and 666 are short-circuited by the analog switch 651.

Similarly, the input terminals and output terminals of the resistors 667, 668, and 669 can be short-circuited by turning the analog switch 652 on through control signal lines 633 and 634. The input terminals and output terminals of the resistors 671 and 672 can be short-circuited by turning the analog switch 653 on through control signal lines 635 and 636. The input terminal and output terminal of the resistor 673 can be short-circuited by turning the analog switch 654 on through control signal lines 637 and 638. Therefore, the resistance value between the input terminal 625 and the output terminal 626 can be made practically zero.

For example, turning the analog switch 651 on makes a switch from a state in which twelve resistors are connected in series between the input terminal 625 and the output terminal 626 to a state in which six resistors are connected in series therebetween, thereby changing the resistance value between the input terminal 625 and the output terminal 626.

As described above, the plurality of variable resistor circuits 605 are connected in series within the gamma correction circuit 64 illustrated in FIG. 5. The gamma correction circuit 64 forms a voltage divider resistor circuit by connecting the variable resistor circuits 605 and the ladder resistor circuits 606 in series. By varying the respective resistance values of the plurality of variable resistor circuits 605, reference gray scale voltages to be output to the reference gray scale voltage wiring lines can be adjusted.

Figure 8:
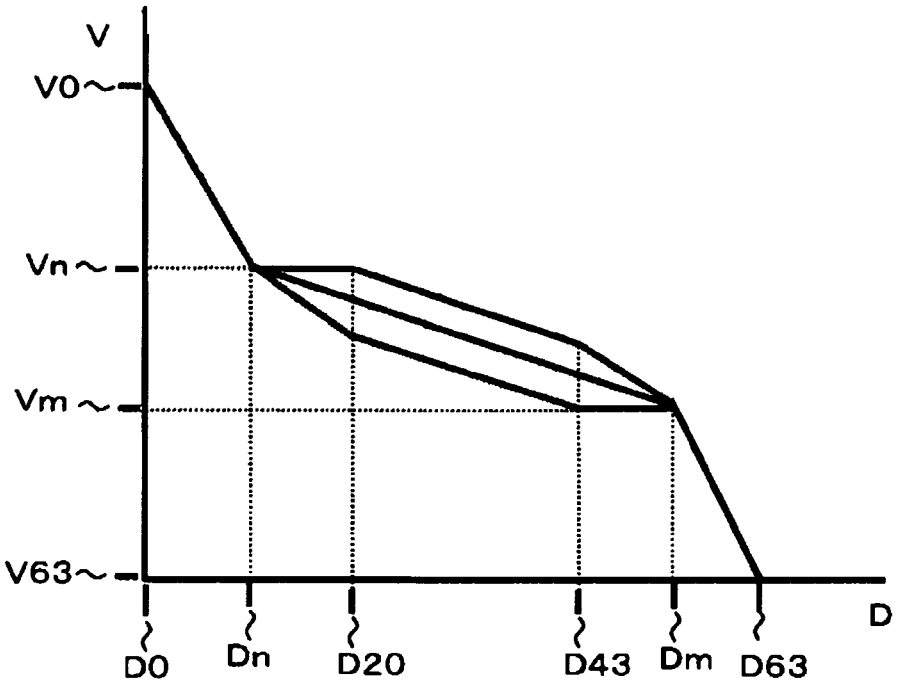
FIG. 8 is a gray scale voltage graph illustrating the gamma correction of the liquid crystal display device according to the embodiment of the present invention.

FIG. 8 illustrates how the fine adjustment register 602 adjusts the gradient of from the display data Dm to Dn. The fine adjustment register 602 is capable of making a fine adjustment of a divided voltage by selecting from among a plurality of output terminals 645 that each ladder resistor circuit 606 has with the use of the relevant selector circuit 607. In FIG. 8, the gradient is finely adjusted by changing the value of the voltage that is output from the ladder resistor circuits 606 at display data D43 and display data D20.

FIG. 12 is a schematic circuit diagram of each ladder resistor circuit 606 and each selector circuit 607. In the ladder circuit 606, resistors 674 to 678 are connected in series, and the wiring lines 645 are connected to the selector circuit 607 from respective contact points of the resistors. A control signal 642 is input to the selector circuit 607 and connected to control terminals of analog switches 655 to 658.

For example, when a High voltage is transmitted to a control signal line 639, the analog switch 655 is turned on and outputs a voltage that is generated at the contact point between the resistors 674 and 675. Using the ladder resistor circuit 606 and the selector circuit 607 in combination enables the gamma correction circuit 64 to selectively take out voltages generated at contact points in the ladder resistor circuit 606.

Figure 9:
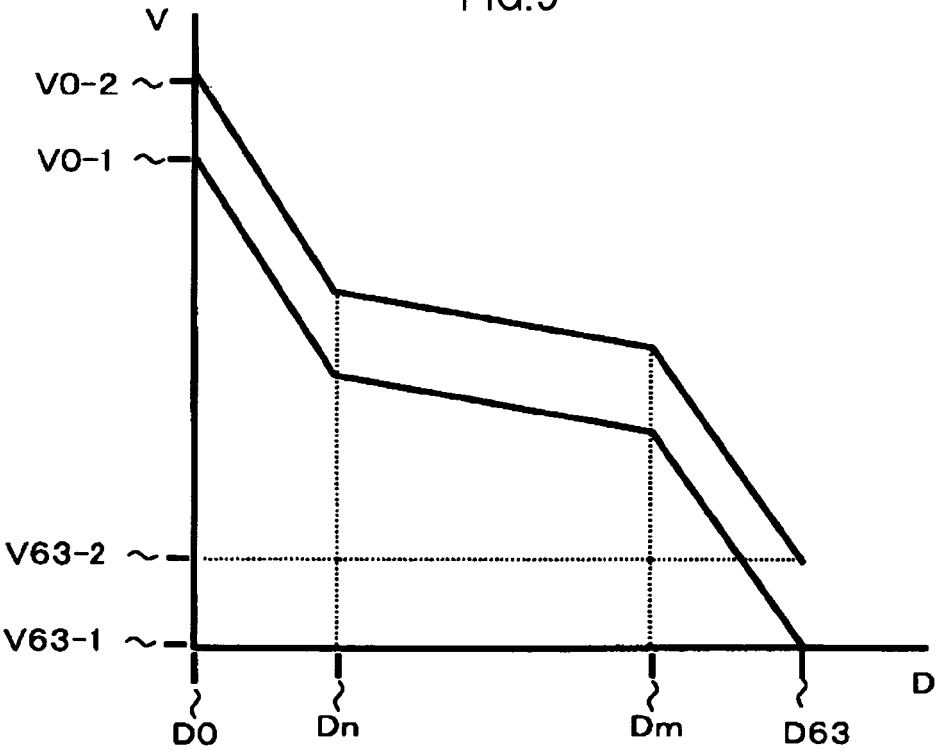
FIG. 9 is a gray scale voltage graph illustrating the gamma correction of the liquid crystal display device according to the embodiment of the present invention.

FIG. 9 illustrates how the amplitude is adjusted. The amplitude adjustment register 603 is capable of adjusting voltages that are output from the reference gray scale voltage wiring lines 610 and 621 by controlling the variable resistor circuits 605-2 and 605-12.

With the reference gray scale voltage V0 output to the reference gray scale voltage wiring line 610, changing the resistance value of the variable resistor circuit 605-2 changes the reference gray scale voltage V0 to a value between reference gray scale voltages V0-1 to V0-2.

Similarly, with the reference gray scale voltage V63 output to the reference gray scale voltage wiring line 621, changing the resistance value of the variable resistor circuit 605-12 changes the reference gray scale voltage V63 to a value between reference gray scale voltages V63-1 to V63-2.

Figure 10:
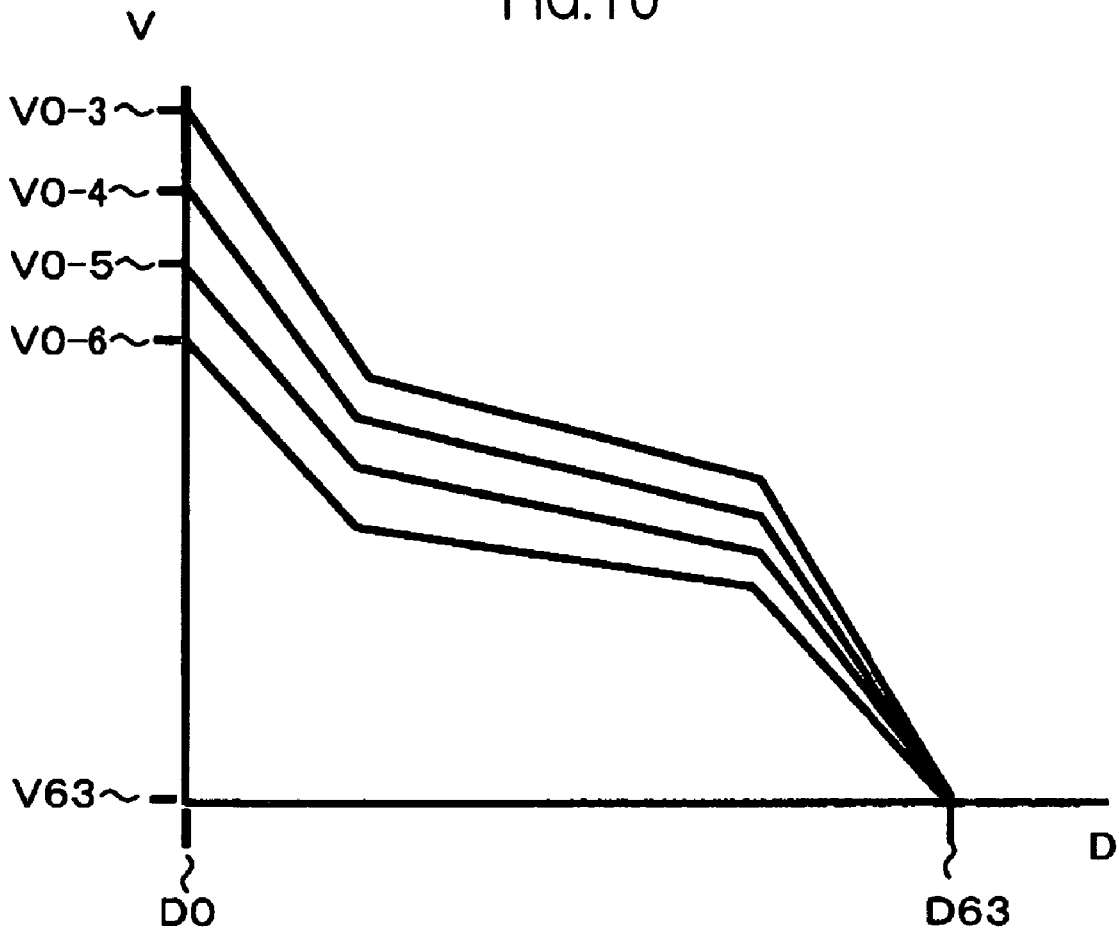
FIG. 10 is a gray scale voltage graph illustrating the gamma correction of the liquid crystal display device according to the embodiment of the present invention.

FIG. 10 illustrates how the amplitude is corrected. The amplitude correction register 604 is capable of changing the reference gray scale voltage V0 to a value between reference gray scale voltages V0-3 to V0-4 by changing the resistance value of the variable resistor circuit 605-1.

Changing the reference gray scale voltage V0 shifts the overall gray scale voltage to the high voltage side or to the low voltage side. A luminance difference is observed in the liquid crystal display panel 1 because, as mentioned above, enhancing the definition varies the wiring resistance depending on the position of the relevant scanning signal line 21. The variable resistor circuit 605-1 corrects the luminance difference in the liquid crystal display panel 1 by varying the resistance value in fine increments or decrements.

As described above, this embodiment is characterized in that a gray scale voltage generated by the gray scale voltage generating circuit 62 is corrected according to the position of the relevant scanning signal line 21. A plurality of pieces of data for correcting a gray scale voltage according to the position of the relevant scanning signal line 21 are therefore written in advance (for example, when the liquid crystal display device 100 is powered on) to the registers illustrated in FIG. 5. Data that indicates the positions of the scanning signal lines 21 is then input in association with the data set to the registers. The resistance values of the variable resistor circuits 605 and the ladder resistor circuits 606 are thus varied and gray scale voltages approximated to a gamma function can be output.

Figure 13:
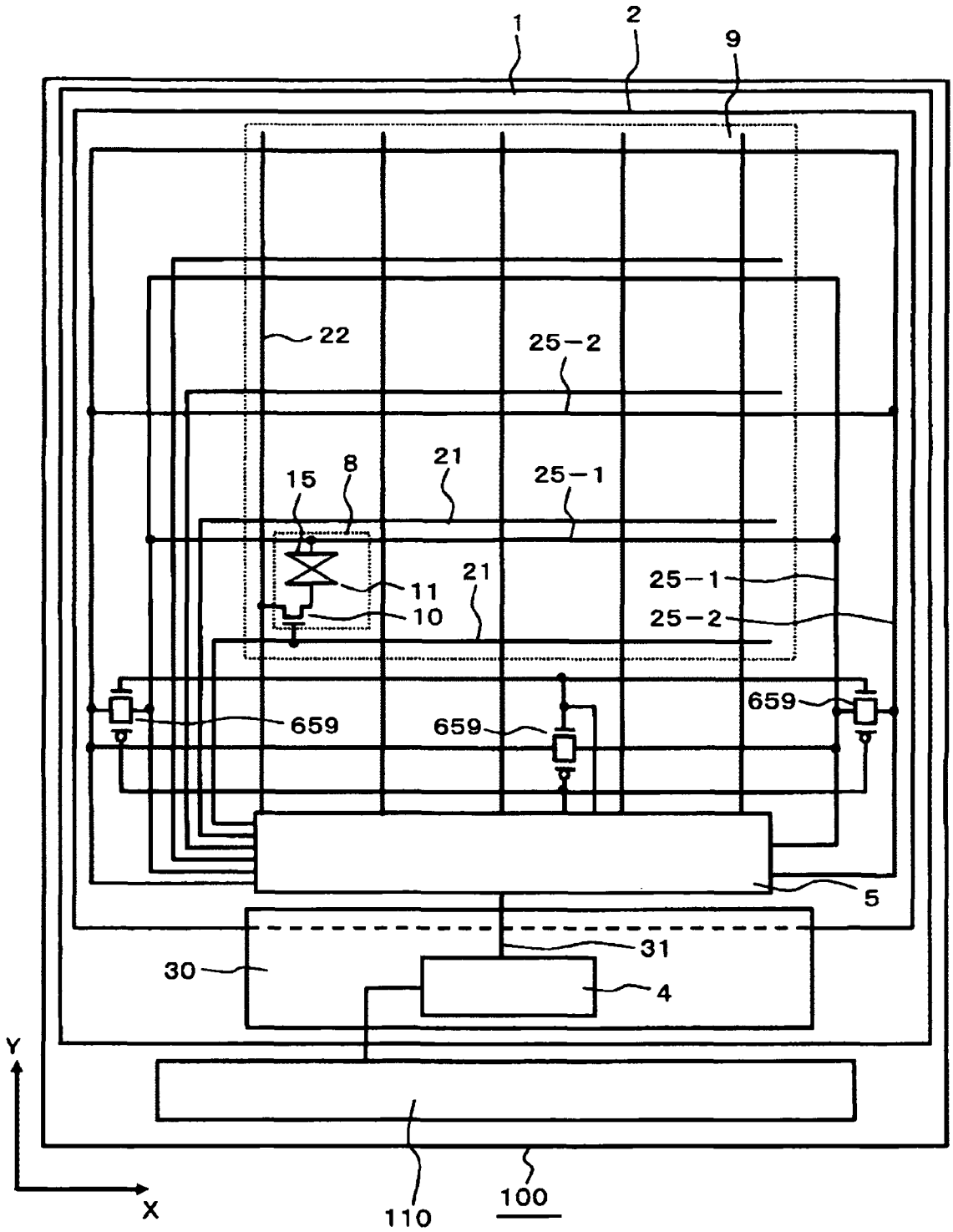
FIG. 13 is a block diagram illustrating a structure of a modification example of the liquid crystal display device according to the embodiment of the present invention.

Described next with reference to FIG. 13 is a method of lightening the load on the drive circuit 5 through equalization. An analog switch 659 is provided between the counter electrode signal lines 25-1 and 25-2, and, in a retrace period or the like, the drive circuit 5 stops outputting a counter electrode voltage and uses the analog switch 659 to short-circuit the counter electrode signal lines 25-1 and 25-2.

Voltages of reverse polarities are applied to the counter electrode signal lines 25-1 and 25-2 as described above, and short-circuiting the counter electrode signal lines 25-1 and 25-2 enables the counter electrode signal lines 25-1 and 25-2 to complement each other with electric charges kept therein. The electric power can thus be saved.

In addition, the counter electrode signal lines 25-1 and 25-2 are set to an intermediate electric potential once before changed to reverse electric potentials. The load on the drive circuit 5 is therefore lightened and makes it easy for an output of the drive circuit 5 to reach the counter electrode voltage of the reverse polarity.

The analog switch 659 may be disposed such that adjacent counter electrode signal lines 25-1 and 25-2 are short-circuited, or so as to short-circuit the counter electrode signal lines 25-1 and 25-2 that are on the two opposing sides of the liquid crystal display panel 1.

The analog switch 659, which can be formed on the TFT substrate 2 by the same process as the one employed for the thin film transistor 10, may instead be formed inside the drive circuit 5.

While there have been described what are at present considered to be certain embodiments of the invention, it is understood that various modifications may be made thereto, and it is intended that the appended claims cover all such modifications as fall within the true spirit and scope of the invention.

What is claimed is:

1. A liquid crystal display device comprising:
- a first substrate;
- a second substrate;
- a liquid crystal composition which is held between the first substrate and the second substrate;
- a plurality of pixel electrodes which are provided on the first substrate;
- a counter electrode which is placed to face corresponding one of the plurality of pixel electrodes;
- a switching element which supplies a data signal to corresponding one of the plurality of pixel electrodes;
- a data signal line which supplies the data signal to the switching element;
- a scanning signal line which supplies a scanning signal for controlling the switching element;
- a counter electrode signal line which supplies a voltage to the counter electrode; and
- a drive circuit which outputs the data signal and the scanning signal,
- wherein the drive circuit includes a gray scale voltage generating circuit having a variable resistor circuit and an amplitude correction register,
- wherein the amplitude correction register holds a plurality data items for correcting a gray scale voltage according to a position of the scanning signal line, and
- wherein the variable resistor circuit has a resistance value which is varied depending on the position of the scanning signal line and the data items held by the amplitude correction register.

2. A liquid crystal display device according to claim 1, wherein the gray scale voltage generating circuit includes a gradient adjustment register that corrects the gray scale voltage for approximating a gamma function by using the variable resistor circuit.

3. A liquid crystal display device according to claim 1, wherein the variable resistor circuit includes a plurality of resistors, which are connected in series, and an analog switch, which short-circuits input terminals and output terminals of the plurality of resistors.

4. A liquid crystal display device comprising:
- a first substrate;
- a second substrate;
- a liquid crystal composition which is held between the first substrate and the second substrate;
- a plurality of pixel electrodes which are provided on the first substrate;
- a counter electrode which is placed to face corresponding one of the plurality of pixel electrodes;
- a switching element which supplies a data signal to corresponding one of the plurality of pixel electrodes;
- a data signal line which supplies the data signal to the switching element;
- a scanning signal line which supplies a scanning signal for controlling the switching element;
- a first counter voltage line and a second counter voltage line which supply voltages to the counter electrode; and
- a drive circuit which outputs the data signal and the scanning signal,
- wherein the drive circuit includes a gray scale voltage generating circuit having an amplitude correction register that holds a plurality of data items for correcting a gray scale voltage according to a position of the scanning signal line,
- wherein the gray scale voltage generating circuit adjusts a resistance value of a variable resistor circuit depending on the position of the scanning signal line, and thereby adjusts an amplitude of a gray scale voltage, and
- wherein the resistance value of the variable resistor circuit is varied according to the data items that are held by the amplitude correction register.

5. A liquid crystal display device according to claim 4, wherein the gray scale voltage generating circuit includes a gradient adjustment register that corrects the gray scale voltage for approximating a gamma function by using the variable resistor circuit to thereby adjust the amplitude of the gray scale voltage.

6. A liquid crystal display device according to claim 4, wherein the variable resistor circuit includes a plurality of resistors, which are connected in series, and an analog switch, which short-circuits input terminals and output terminals of the plurality of resistors.

7. A liquid crystal display device comprising:
- a first substrate;
- a second substrate;
- a liquid crystal composition which is held between the first substrate and the second substrate;
- a plurality of pixel electrodes which are provided on the first substrate;
- a counter electrode which is placed to face corresponding one of the plurality of pixel electrodes;
- a switching element which supplies a data signal to corresponding one of the plurality of pixel electrodes;

a data signal line which supplies the data signal to the switching element;

a scanning signal line which supplies a scanning signal for controlling the switching element;

a first counter voltage line and a second counter voltage line which supply counter voltages to the counter electrode;

a drive circuit which outputs the data signal, the scanning signal, and the counter voltages; and an equalizer circuit which short-circuits the first counter voltage line and the second counter voltage line, wherein the drive circuit includes a gray scale voltage generating circuit having an amplitude correction register that holds a plurality of data items for correcting a gray scale voltage according to a position of the scanning signal line, wherein the gray scale voltage generating circuit varies a resistance value of a variable resistor circuit depending on the position of the scanning signal line, and thereby adjusts an amplitude of a gray scale voltage, and wherein the resistance value of the variable resistor circuit is varied according to the data items that are held by the amplitude correction register.

8. A liquid crystal display device according to claim 7, wherein the gray scale voltage generating circuit includes a gradient adjustment register that corrects the gray scale voltage for approximating a gamma function by using the variable resistor circuit to thereby adjust the amplitude of the gray scale voltage.

9. A liquid crystal display device according to claim 7, wherein the variable resistor circuit includes a plurality of resistors, which are connected in series, and an analog switch, which short-circuits input terminals and output terminals of the plurality of resistors.

* * * * *